United States Patent [19]

Franke et al.

[11] 4,387,148

[45] Jun. 7, 1983

[54] ELECTROPHOTOGRAPHIC RECORDING MATERIAL AND PROCESS FOR ITS PRODUCTION

[75] Inventors: Werner Franke, Wiesbaden; Markus Seibel, Mainz; Richard Brahm, Ingelheim; Hans Trittler, Wiesbaden, all of Fed. Rep. of Germany

[73] Assignee: Hoechst Aktiengesellschaft, Frankfurt am Main, Fed. Rep. of Germany

[21] Appl. No.: 293,127

[22] Filed: Aug. 17, 1981

[30] Foreign Application Priority Data

Aug. 30, 1980 [DE] Fed. Rep. of Germany ..... 3032773

[51] Int. Cl.[3] ..... G03G 5/14

[52] U.S. Cl. ..... 430/66; 430/132

[58] Field of Search ..... 430/66, 67, 132; 204/159.19

[56] References Cited

U.S. PATENT DOCUMENTS

| | | | |
|---|---|---|---|
| 2,860,048 | 11/1958 | Deubner . | |
| 3,037,861 | 6/1962 | Hoegl et al. . | |
| 3,162,532 | 12/1964 | Hoegl et al. . | |
| 3,169,060 | 2/1965 | Hoegl . | |
| 3,307,940 | 3/1967 | Hoegl et al. . | |
| 3,434,832 | 3/1969 | Joseph et al. . | |
| 3,484,237 | 12/1969 | Shattuck et al. . | |
| 3,617,265 | 11/1971 | Petruzzella . | |
| 3,842,038 | 10/1974 | Loehr et al. . | |
| 4,092,173 | 5/1978 | Novak et al. | 430/66 |
| 4,255,464 | 3/1981 | van der Kallen | 204/159.16 |

FOREIGN PATENT DOCUMENTS

| | | | |
|---|---|---|---|
| 53-63018 | 6/1978 | Japan | 430/67 |
| 1178592 | 1/1970 | United Kingdom . | |
| 1534159 | 11/1978 | United Kingdom . | |

OTHER PUBLICATIONS

Chemical Abstracts 86, No. 12, pp. 623–624 (1977): abstract of Japanese Published Application 75–54,441.

*Primary Examiner*—John E. Kittle
*Assistant Examiner*—John L. Goodrow
*Attorney, Agent, or Firm*—Schwartz, Jeffery, Schwaab, Mack, Blumenthal & Koch

[57] ABSTRACT

An electrophotographic recording material comprising an electrically conductive support, a photoconductor layer and an about 1 to about 50 μm thick protective layer comprising a radiation-hardened, crosslinked polyester which is formed from trimethylol propane, adipic acid and acrylic acid and which has a surface resistance ranging from about $5.5 \cdot 10^{12}$ to about $2.5 \cdot 10^{13}$ ohm and a volume resistivity ranging from about $7 \cdot 10^{10}$ to about $5 \cdot 10^{13}$ ohm cm, measured at 23° C. and 50 percent relative humidity, and a process for producing such a recording material.

17 Claims, No Drawings

ELECTROPHOTOGRAPHIC RECORDING MATERIAL AND PROCESS FOR ITS PRODUCTION

BACKGROUND OF THE INVENTION

The present invention relates to an electrophotographic material which comprises an electrically conductive support, a photoconductor layer applied thereto formed of organic or inorganic photoconductive substances, and a protective layer covering the photoconductor layer. The invention also relates to a process for producing such an electrophotographic material.

Electrophotographic recording materials provided with organic photoconductor layers are disclosed in U.S. Pat. No. 3,037,861, U.S. Pat. No. 3,307,940, U.S. Pat. No. 3,169,060 and in British Pat. No. 1,178,592. Materials with inorganic photoconductors, such as selenium layers, are described in U.S. Pat. No. 3,434,832.

The production of dry copies according to the so-called toner image transfer process requires thorough cleaning of the photoconductor layer after each transfer. Cleaning is usually done by brushing or wiping the photoconductor with brushes or cloths. In transfer processes using liquid developers, the cleaning action is increased by additionally applying a liquid cleaning agent. Such cleaning operations produce mechanical stresses on the photoconductor layer and may thus damage the layer and lead to the occurrence of wear.

In addition to these cleaning operations, other detrimental influences act on the photoconductor layer. For example, the layer is subject to the action of a developer composed of carrier and toner particles and, in the case of liquid development, also to the action of the developing liquid which must not in any event cause an incipient dissolution or swelling of the photoconductor layer. In addition, the ionized air generated in the charging station may damage the photoconductor layer by causing cracking or embrittlement phenomena.

Generally, these influences will adversely affect the photoconductor layer and, consequently, shorten its useful life.

U.S. Pat. Nos. 2,860,048 and 3,617,265 and German Offenlegungsschriften 15 72 368 and 24 52 623 disclose protecting photoconductor layers from the above-described influences by providing them with a protective layer. However, comparatively high temperatures are required during or after the coating procedure for applying these coverings. As a result, the dimensional stability of the support may suffer, for example, if the support is a plastic film. Furthermore, the electric properties of the applied protective coatings do not meet the high standards needed with respect to sufficient discharge of the photoconductor layer when exposed to a light image. The undesirably high residual charge which remains leads to copies of reduced contrast which have a darkened background. Some of the covering described in the prior art also have an undesirable tendency towards turbidity or haziness.

Japanese published patent application Ser. No. 75-54,441 discloses using protective layers of polymerized cinnamic esters for electrophotographic materials. Such materials are, however, expensive special manufactures which are not well suited for normal technical application.

SUMMARY OF THE INVENTION

It is the object of the present invention to provide a new electrophotographic recording material having a photoconductive layer provided with a protective coating.

Another object of the present invention is to provide an electrophotographic recording material which has a high resistance to damage during cleaning between cycles.

A further object of the present invention is to provide an electrophotographic recording material which has improved abrasion resistance.

An additional object of the present invention is to provide an electrophotographic recording material which resists deterioration due to exposure to solvents.

It is also an object of the present invention to provide an electrophotographic recording material which has a long service life.

Yet another object of the present invention is to provide an electrophotographic recording material provided with a protective cover layer made from readily available commercial materials.

A still further object of the present invention is to provide an electrophotographic recording material which exhibits outstanding electrical properties with respect to satisfactory charging of the photoconductor and discharge of the photoconductive layer when exposed to a light image.

Additionally, it is an object of the present invention to provide an electrophotographic recording material which resists cracking or embrittlement upon exposure to ionized air.

Another object of the present invention is to provide an electrophotographic recording material which produces copies exhibiting a sharp contrast between image areas and background areas.

It is a further object of the present invention to provide an electrophotographic recording material which has a reduced tendency toward turbity or haziness.

Another object of the invention is to provide an electrophotographic recording material which is dimensionally stable under the conditions of manufacture and use.

Yet another object of the invention is to provide a process for providing an electrophotographic recording material of the aforementioned type.

These and other objects of the invention are achieved by providing an electrophotographic recording material comprising an electrically conductive support, a photoconductive layer, and a protective layer comprising a radiation-hardened, crosslinked polyester formed from trimethylol propane, adipic acid and acrylic acid; said protective layer having a surface resistance lying in the range from about $5.5\times10^{12}$ to about $2.5\times10^{13}$ ohms and a volume resistivity ranging from about $7\times10^{10}$ to about $5\times10^{13}$ ohm cm at 23° C. and 50 percent relative humidity.

In a further aspect of the invention, the objects are achieved by providing a process for producing an electrophotographic recording material comprising forming a mixture of a polyester formed from trimethylol propane, adipic acid and acrylic acid, and a photoinitiator in a solvent; applying a layer of said mixture to the surface of an electrophotographic recording material comprising an electrically conductive support and a photoconductive layer; drying the applied layer; and hardening the applied layer by subjecting it to radiation;

said polyester having a surface resistance of about $5.5\times10^{12}$ to about $2.5\times10^{13}$ ohm and a volume resistivity lying in the range from about $7\times10^{10}$ to about $5\times10^{13}$ ohm cm measured at 23° C. and 50 percent relative humidity.

DETAILED DESCRIPTION OF THE PREFERRED EMBODIMENTS

Particularly preferred protective layers comprise a polyester formed from trimethylol propane, adipic acid and acrylic acid which has an acid number between 20 and 25, an ester number between 470 and 480 and an unsaturated (C=C) proportion from 3.5 to 4.0. It is thus possible to provide electrophotographic recording materials which have a prolonged useful life, while substantially maintaining their original photoconductive properties. It is further possible to employ photoconductor layers which contain substances having high vapor pressures, since the protective layer prevents any egress of vapors and allows environmentally safe use of such materials.

The protective layer of the present invention is advantageously applied to the organic photoconductor layer by forming a mixture composed of the polyester to be crosslinked by irradiation with ultraviolet light, a photoinitiator, a solvent, and a levelling agent or flow agent and applying the mixture to the photoconductor layer. Preferably, the thickness of the protective layer on the photoconductor will lie in the range from about 1 to about 50 μm, preferably from about 1 to about 10 μm. Optionally, the mixture may also comprise a binder or thickening agent. The mixture may also optionally comprise a substance which further improves abrasion resistance.

The photoconductor layer is deposited on an electrically conductive support which may comprise a metal web, a metal plate, a plastic film which has been rendered conductive, or a metal drum.

The photoinitiator may be any substance from the class of benzoin ethers or aromatic ketones, which are conventionally known as reaction starters, such as 2-hydroxy-2-methyl-1-phenylpropane-1-one.

The preferred binders or thickening agents are materials such as cellulose esters, particularly cellulose acetobutyrate. They serve primarily to adjust the viscosity of the solution to be applied.

Levelling agents are known in the art and are used to ensure formation of a surface which is free of pores. Examples of suitable levelling agents include ethylene glycol monomethyl ether (methyl cellosolve) and/or n-butanol.

Suitable solvents are those which have a good dissolving power for the substances to be applied as the protective layer, but which do not incipiently dissolve the underlying photoconductor layer. Generally, solvent mixtures, such as mixtures of acetone and methanol, are used.

To increase the abrasion resistance, inorganic oxides, such as aluminum oxide, silicon dioxide and mixed oxides having a grain size which does not cause turbidity of the layer may be incorporated in the protective layer.

The protective layer of the invention may further contain small amounts of metal ions for adjusting the electrical properties of the layer. It has proved advantageous for the protective layer to contain about 20 mg of chromium ions, from 150 to 190 mg of iron ions, from 28 to 35 mg of nickel ions and from 10 to 20 mg of zinc ions per kilogram of polyester.

The protective layer may be applied over the photoconductor layer by conventional coating methods, such as casting, spraying, dipping or spreading.

The protective layer is preferably hardened by the action of ultraviolet radiation. It may, however, also be hardened by the action of an electron beam.

Irradiation for hardening is advantageously effected by using high-pressure mercury vapor lamps. A tube exposure apparatus may, for example, also be used as the light source, however, an oxygen barrier layer must then be applied before irradiation and this layer must be removed again prior to using the electrophotographic recording material.

The electrophotographic recording material of the invention is characterized by high abrasion resistance and by its resistance to highly insulating, aliphatic hydrocarbons used as the developing media in liquid developers. Abrasion measured on aluminum sheets coated according to the present invention is, for example, up to 200 times lower than in the case of an electrophotographic recording material which has no protective layer but is otherwise identical.

Despite the presence of the protective layer, the recording material of the invention exhibits substantially the same capacity to make copies as a corresponding recording material without a protective layer. A coated aluminum drum, for example, produced usable copies even after more than 100,000 cycles in a liquid developer of the aforementioned kind, whereas a similar photoconductor layer without a protective layer had been rendered useless by the attack of the carrier liquid of the developer after the production of only a few copies. In addition, the protective layer of the present invention can be charged either negatively or positively.

The protective layer of the invention also makes it possible to use photoconductor layers which, if not sealed by the protective layer, could cause injuries to health, for example, being rubbed off, by contacting the skin, by releasing vapors, or the like. In addition, the protective layer of the invention exhibits the favorable property that it does not tend to become turbid or hazy. Nor does it require any special protective measures like those required when nitrocellulose is used as the protective layer.

the electrophotographic recording material of the invention is produced by a process for applying a protective layer to an electrophotographic recording material comprising an electrically conductive support and a photoconductor layer formed of organic or inorganic substances wherein a mixture of a polyester which is formed from trimethylol propane, adipic acid and acrylic acid and which has a surface resistance of $5.5\cdot10^{12}$ to about $2.5\cdot10^{13}$ ohm and a volume resistivity ranging from $7\cdot10^{10}$ to $5\cdot10^{13}$ ohm cm, measured at 23° C. and 50 percent relative humidity, a photoinitiator, optionally a binder and/or thickening agent and a levelling agent, is prepared in a solvent, such as mixture of acetone and methanol, and is then applied to the photoconductor layer, dried and hardened by irradiation with ultra-violet rays or electron beams.

It is thus possible to provide photoconductor layers formed of organic or inorganic substances, with protective layers of uniform thicknesses in the range from about 1 to about 50 μm, without significantly adversely influencing their electrophotographic properties and without incipiently dissolving the photoconductor layer. The resulting protective layers impart a prolonged useful life to the electrophotographic recording material.

The invention will be explained in further detail with reference to the following, non-limiting examples wherein all proportions are expressed in terms of parts by weight unless otherwise indicated:

EXAMPLE 1

An electrophotographic element is prepared as described in German Auslegeschrift No. 21 37 288 comprising a 280 μm thick aluminum sheet to which a 10 μm thick photoconductor layer is applied which has the follo,wing composition: 297 parts of a condensation product of bromopyrene and formaldehyde, 31 parts 2,7-dinitro-9-cyanomethylene-fluorene, 107 parts of a standard type 4E nitrocellulose according to DIN 53,179 made into a paste in a 30 percent butanol, and 5 parts by volume of a wetting agent. The resulting electrophotographic element is then provided with a photocrosslinkable cover layer of about 4 μm thickness (after drying) by dip-coating in a solution of

| | |
|---|---|
| 750 | parts crosslinkable polyester resin formed from adipic acid, trimethylol propane and acrylic acid, |
| 29 | parts cellulose acetobutyrate, |
| 575 | parts acetone, |
| 1,400 | parts methanol, |
| 100 | parts n-butanol, |
| 100 | parts ethylene glycol monomethyl ether, and |
| 37.5 | parts ultraviolet hardener (photoinitiator). |

The drawing rate (i.e., the speed at which the electrophotographic element is pulled out of the coating solution) may range from 120 to 420 mm/minute and is, in this case, 240 mm/minute. The solution has a viscosity of 5 cSt at 25° C.

The protective layer thus applied is hardened by irradiation for an exposure time of 5 seconds with a high-pressure mercury vapor lamp (Hanau, type Q 2020, 100 W/cm) disposed at a distance of 5 cm.

EXAMPLE 2

A protective layer is prepared as described in Example 1. An oxygen barrier layer is then applied over the protective layer. The oxygen barrier can, after hardening be removed again by washing with cold water or by peeling off in the dry state and has the following composition:

| | |
|---|---|
| 200 | parts polyvinyl alcohol, |
| 3,500 | parts distilled water, |
| 9.6 | parts phenyl sulfonate, and |
| 0.8 | parts fluorinated wetting agent |

The mixture is applied by dip-coating at a drawing rate of 200 mm/minute.

The photo-crosslinkable layer is hardened on a tube exposure apparatus (manufactured by Philips TLA 20 W/05, 10 tubes on 50×80 cm) under vacuum (about 20 to 40% of normal pressure), at an exposure time of 6 minutes.

The abrasion resistance of the coatings is determined by testing the mechanical abrasion on a Type 352 Taber Abraser, using abrasive rollers subjected to a load of 250 g, after 200 revolutions of the rollers.

As control sample, an unprotected photoconductor layer is used. As can be seen from the following Table I, the dry abrasion of the protected layer is up to 200 times lower than the abrasion of the unprotected photoconductor layer.

The charge levels of a negatively charged photoconductor and also of a positively charged photoconductor layer carrying a protective layer are approximately equal and correspond approximately to the charge levels of unprotected layers.

TABLE I

| | abrasion in g/m² | | | |
|---|---|---|---|---|
| after | 50 | 100 | 200 | cycles |
| unprotected photoconductor layer | 1.021 | 1.583 | 2.725 | |
| photoconductor layer provided with protective layer | 0 | 0.008 | 0.012 | |

EXAMPLE 3

An aluminum drum having a length of 292 mm and an outside diameter of 120 mm is used as a support for a photoconductor layer prepared as described in Example 1. After application of a protective layer according to Example 1 and an oxygen barrier layer according to Example 2, exposure is carried out for 15 minutes on a tube exposure apparatus as described in Example 2, without vacuum and with the drum rotating.

The coating prepared in this way is tested in an abrasion tester under the action of a wiper blade as used in conventional copying machines and under the conditions of liquid development. It is found that, even after more than 100,000 revolutions of the drum, the protective layer has not been attacked, and the electrophotographic drum still yields good copies.

EXAMPLE 4

A layer as described in Example 1, which is hardenable by ultraviolet radiation, is applied by dip-coating to a selenium-coated aluminum drum. It is then prepared for exposure by applying an oxygen barrier layer as described in Example 2, and the coated electrophotographic drum is subsequently exposed under the conditions described in Example 3.

The photoelectric properties are virtually unchanged by the protective layer, and the positively charged drum is found to exhibit a satisfactory copying behavior in the copying test.

The foregoing embodiments have been described merely as illustrative examples of the invention and are not intended to be limiting. Since modifications of the disclosed embodiments incorporating the spirit and substance of the invention may occur to persons skilled in the art, the scope of the invention is to be limited solely with respect to the appended claims and equivalents.

We claim:

1. An electrophotographic recording material comprising an electrically conductive support, a photoconductor layer, and a protective layer comprising a radiation-hardened, crosslinked polyester which is formed from trimethylol propane, adipic acid and acrylic acid and which has a surface resistance ranging from about $5.5 \cdot 10^{12}$ to about $2.5 \cdot 10^{13}$ ohm and a volume resistivity ranging from about $7 \cdot 10^{10}$ to about $5 \cdot 10^{13}$ ohm cm measured at 23° C. and 50 percent relative humidity.

2. A recording material according to claim 1, wherein the polyester has an acid number lying in the range from 20 to 25, an ester number lying in the range from 470 to 480 and an unsaturated proportion from 3.5 to 4.0.

3. A recording material according to claim 1, wherein the polyester contains about 20 mg of chromium ions, from 150 to 190 mg of iron ions and from 28 to 35 mg of nickel ions and 10 to 20 mg of zinc ions per kilogram of the polyester.

4. A recording material according to claim 1 or claim 2, wherein said protective layer has a thickness lying in the range from about 1 to about 50 μm.

5. A recording material according to claim 1, wherein said protective layer comprises inorganic oxides selected from the group of aluminum oxide, silicon dioxide and mixed oxides having a grain size which does not cause turbidity of the layer.

6. A recording material according to claim 1, wherein said photoconductor layer comprises an organic photoconductor substance.

7. A recording material according to claim 1, wherein said photoconductor layer comprises an inorganic photoconductor substance.

8. A process for producing a protective layer on an electrophotographic recording material comprising an electrically conductive support and a photoconductor layer, wherein a mixture comprising a polyester formed from trimethylol propane, adipic acid and acrylic acid, and a photoinitiator, is prepared in a solvent and is applied to the photoconductor layer, dried and hardened by irradiation; said polyester having a surface resistance of $5.5 \cdot 10^{12}$ to about $2.5 \cdot 10^{13}$ ohm and a volume resistivity from $7 \cdot 10^{10}$ to $5 \cdot 10^{13}$ ohm cm, measured at 23° C. and 50 percent relative humidity.

9. A process according to claim 8, wherein said polyester contains about 20 mg of chromium ions, from 150 to 190 mg of iron ions and from 28 to 35 mg of nickel ions and from 10 to 20 mg of zinc ions per kilogram of the polyester.

10. A process according to claim 8, wherein said mixture further comprises a binder.

11. A process according to claim 8, wherein said mixture further comprises a thickening agent.

12. A process according to claim 8, wherein said mixture further comprises a levelling agent.

13. A process according to claim 8, wherein said mixture further comprises inorganic oxides selected from the group of aluminum oxide, silicon dioxide and mixed oxides.

14. A process according to claim 8, wherein said solvent is a solvent mixture of acetone and methanol.

15. A process according to claim 8, wherein said polyester is hardened by subjecting it to ultraviolet radiation.

16. A process according to claim 8, wherein said polyester is hardened by subjecting it to an electron beam.

17. A process according to claim 8, further comprising applying an oxygen barrier over said protective layer prior to hardening said protective layer.

* * * * *